US010428569B2

(12) United States Patent
Su

(10) Patent No.: US 10,428,569 B2
(45) Date of Patent: Oct. 1, 2019

(54) DOOR CLOSER

(71) Applicant: ARCTEK INDUSTRIAL CO., LTD., Changhua County (TW)

(72) Inventor: Wen-Yuan Su, Changhua County (TW)

(73) Assignee: ARCTEK INDUSTRIAL CO., LTD., Changhua County (TW)

( * ) Notice: Subject to any disclaimer, the term of this patent is extended or adjusted under 35 U.S.C. 154(b) by 33 days.

(21) Appl. No.: 15/698,778

(22) Filed: Sep. 8, 2017

(65) Prior Publication Data

US 2019/0024428 A1 Jan. 24, 2019

(30) Foreign Application Priority Data

Jul. 18, 2017 (TW) ..... 106123930 A

(51) Int. Cl.

*E05F 3/12* (2006.01)
*E05F 3/10* (2006.01)
*E05F 3/22* (2006.01)

(52) U.S. Cl.

CPC ..... *E05F 3/12* (2013.01); *E05F 3/104* (2013.01); *E05F 3/22* (2013.01); *E05F 3/223* (2013.01); *E05Y 2201/418* (2013.01); *E05Y 2900/132* (2013.01)

(58) Field of Classification Search

CPC ..... E05F 3/12; E05F 3/22; E05F 3/104; E05F 3/223

See application file for complete search history.

(56) References Cited

U.S. PATENT DOCUMENTS 3,337,902 A * 8/1967 Webb ..... E05F 3/102 16/62
6,397,430 B1 * 6/2002 Brown ..... E05F 3/104 16/51
8,181,311 B2 * 5/2012 Chiang ..... E05F 3/104 16/56
8,863,357 B1 * 10/2014 Chang ..... E05F 3/12 16/49
9,714,534 B1 * 7/2017 DeGott ..... E05F 3/104
2017/0314583 A1 * 11/2017 Koscielniak ..... B64C 1/1423

FOREIGN PATENT DOCUMENTS

CN 2032237 U 2/1989
CN 2165204 Y 5/1994
DE 8704569 U1 7/1987
GB 1250621 A 10/1971

(Continued)

OTHER PUBLICATIONS

Taiwanese Office Action dated Nov. 28, 2017 for Taiwanese Patent Application No. 106123930, 5 pages.

(Continued)

*Primary Examiner* — Victor D Batson
*Assistant Examiner* — Matthew J Sullivan
(74) *Attorney, Agent, or Firm* — Jackson IPG PLLC; Demian K. Jackson

(57) ABSTRACT

A door closer pivoted on a door at least includes a case and a piston. When the door is open, the door closer blocks a communicating hole of the case by an oil sealing ring of the piston to allow an oil filled in the door closer cannot flow through the communicating hole. As a result, the open door can be held in a predetermined position.

10 Claims, 10 Drawing Sheets

(56) References Cited

FOREIGN PATENT DOCUMENTS

| | | |
|---|---|---|
| TW | 450308 | 8/2001 |
| TW | M461680 U | 9/2013 |
| TW | I522523 B | 2/2016 |

OTHER PUBLICATIONS

European Full Search Report dated Nov. 7, 2018 for European Patent Application No. 17195694.9, 13 pages.
European Partial Search Report dated Jun. 25, 2018 for European Patent Application No. 17195694.9, 12 pages.

* cited by examiner

DOOR CLOSER

FIELD OF THE INVENTION

This invention relates to a door closer pivoted on a door, and the door closer can hold the open door in a predetermined position for normally opening.

BACKGROUND OF THE INVENTION

A door is conventionally pivoted on a door frame by a door closer in order to close the open door. When the door is required to be held in normal open position, a blocker is provided to block the open door to keep the door open. However, it is inconvenient to remove the blocker from the door for closing the door.

SUMMARY

The primary object of the present invention is to provide a door closer pivoted on a door, the door closer can hold the door in a predetermined position when the door is open.

The door closer of the present application includes a case and a piston. The case includes a piston accommodating chamber and a channel connecting module, and the channel connecting module includes a first communicating hole and a second communicating hole. The piston is installed in the piston accommodating chamber to divide the piston accommodating chamber into a first oil storage space and a first opening space. The channel connecting module communicates with the first opening space by the first communicating hole and communicates with the first oil storage space by the second communicating hole. The piston includes a main body and an oil sealing ring which is coupled to and moved together with the main body in the piston accommodating chamber. The oil sealing ring is adapted to block the first communicating hole for holding the door in a predetermined position when the door is open.

DETAILED DESCRIPTION OF THE INVENTION

Figure 1:
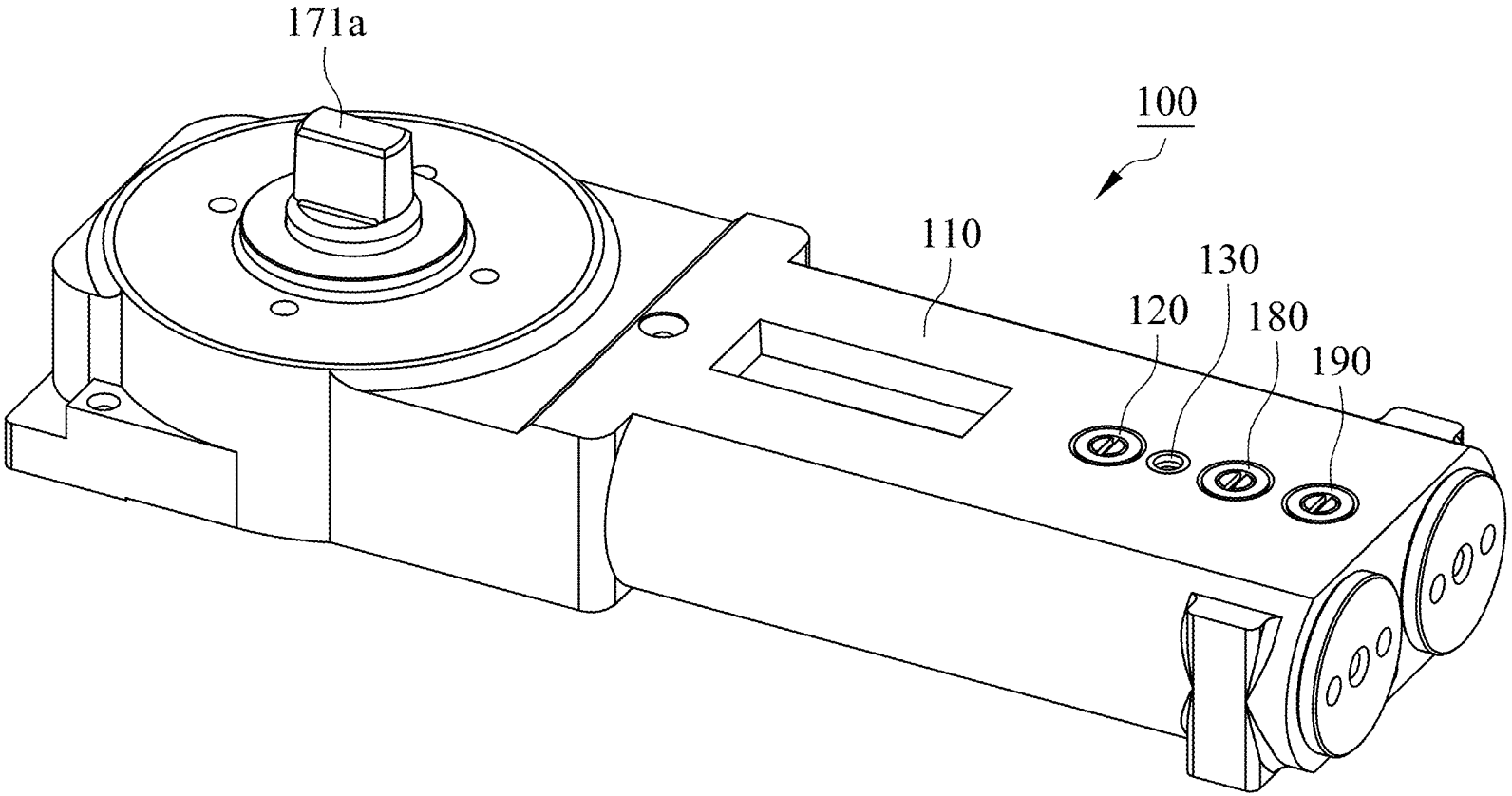
FIG. 1 is a perspective assembly diagram illustrating a door closer of the present invention.
Figure 2:
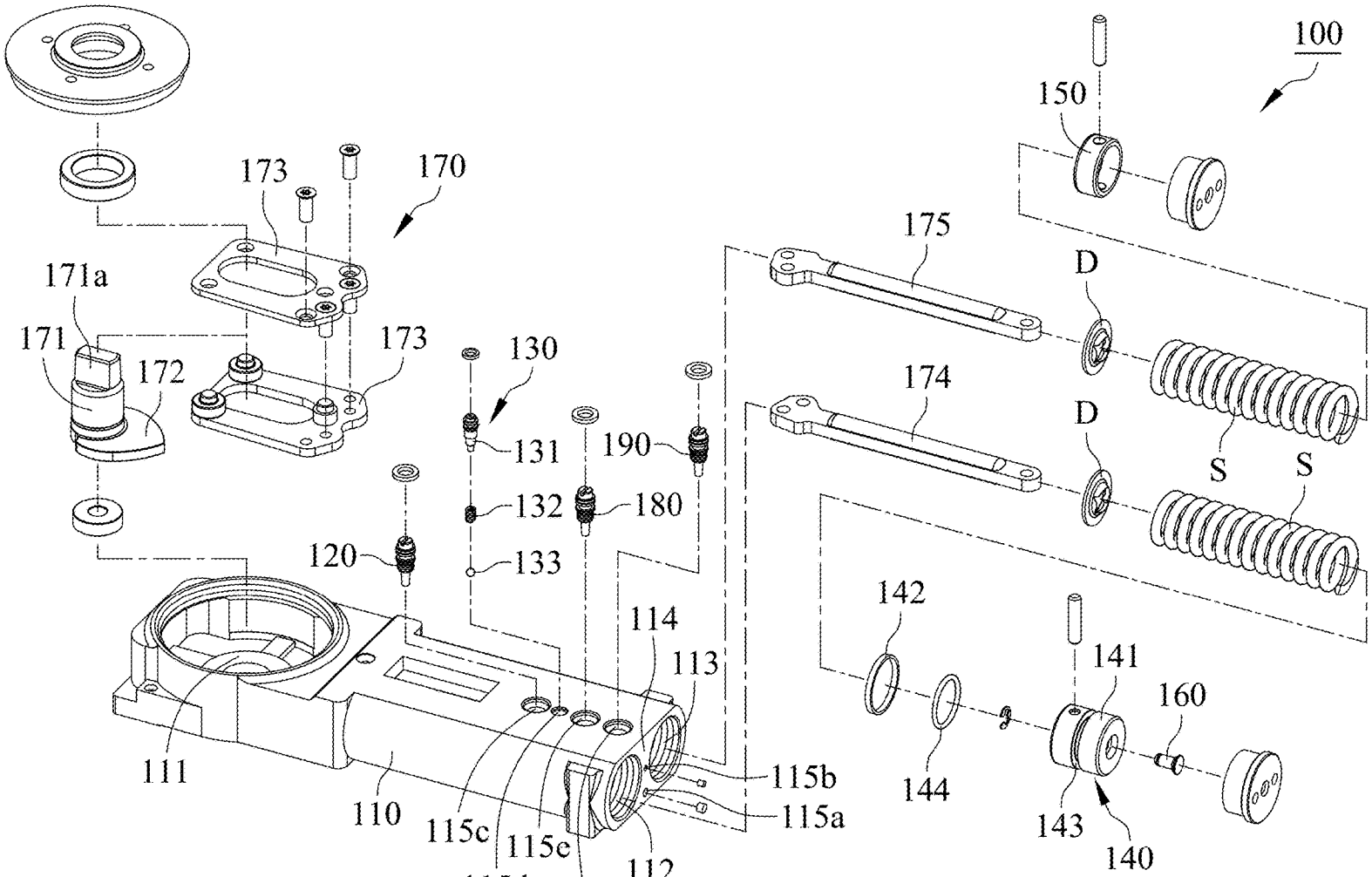
FIG. 2 is a perspective exploded diagram illustrating the door closer of the present invention.
Figure 3:
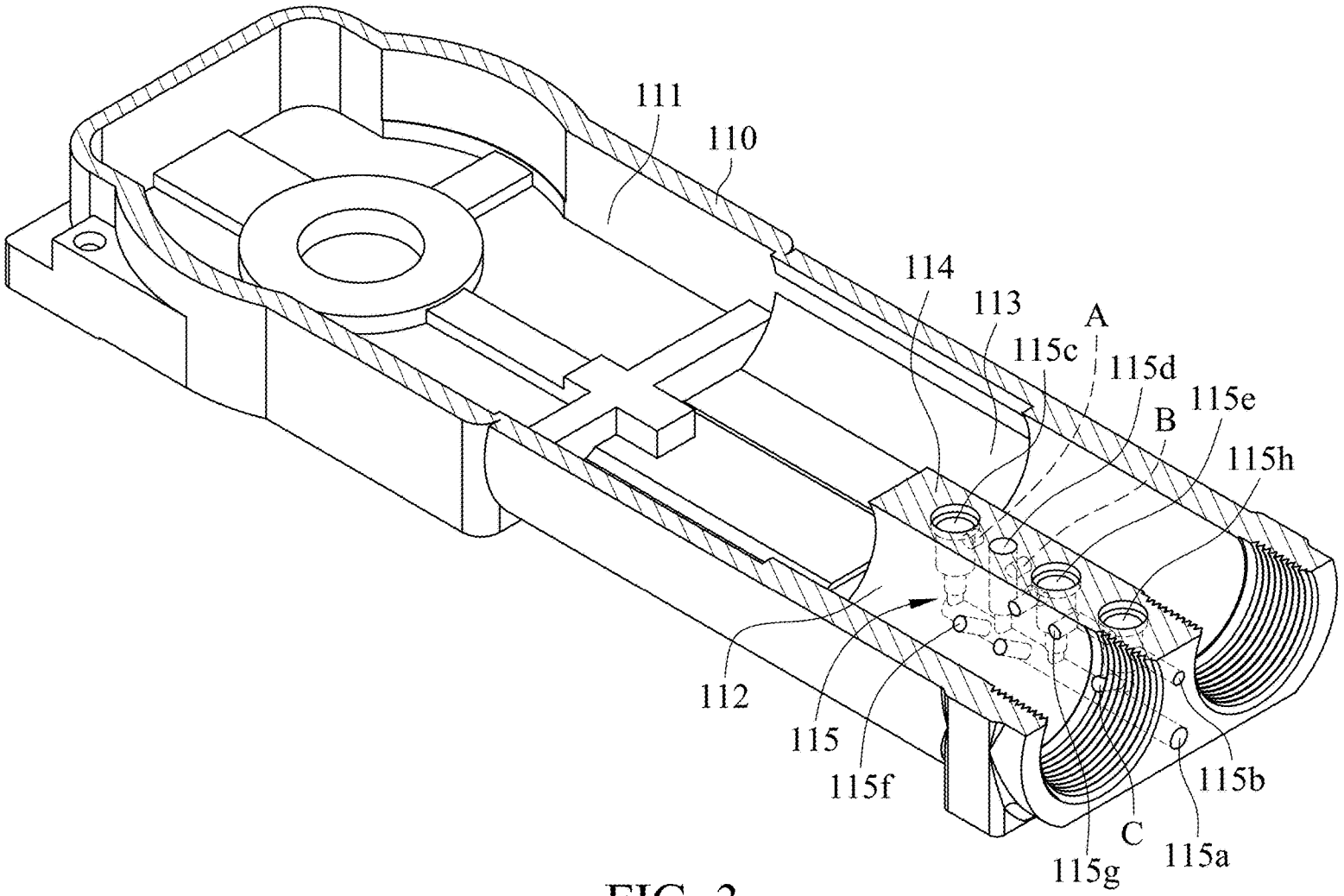
FIG. 3 is a perspective cross-section view diagram illustrating a case of the door closer of the present invention.
Figure 4:
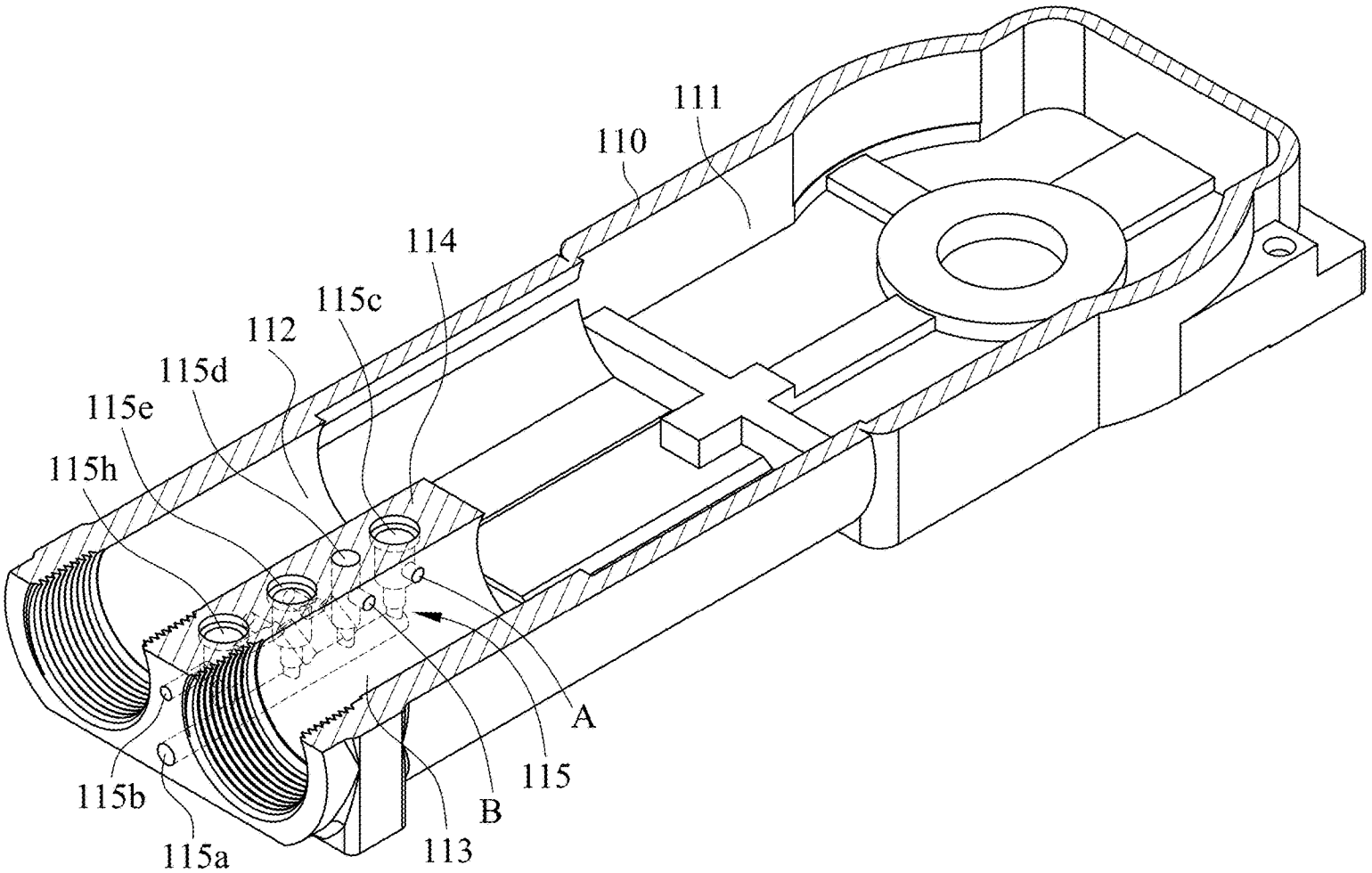
FIG. 4 is a perspective cross-section view diagram illustrating the case of the door closer of the present invention.
Figure 6:
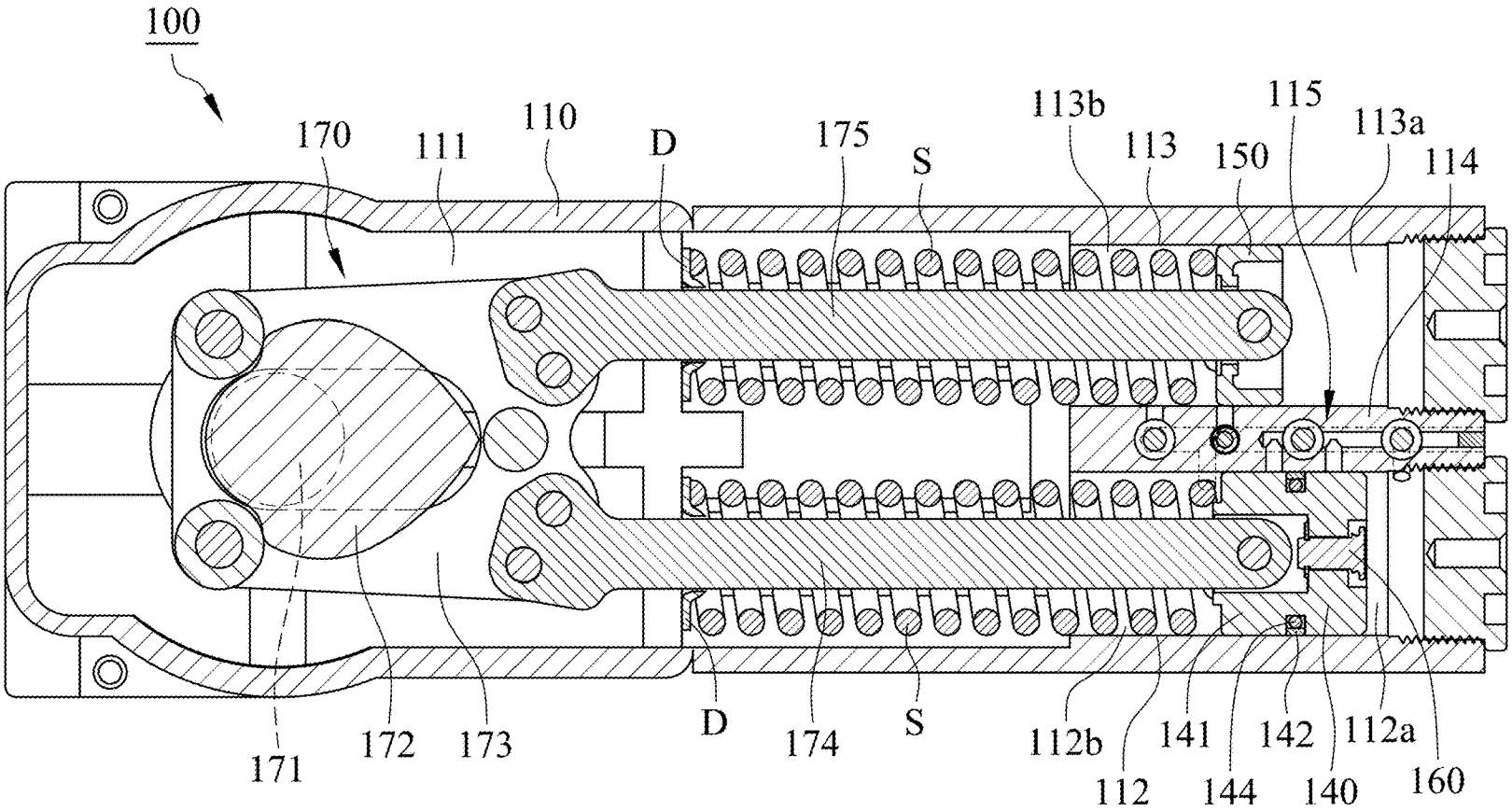
FIG. 6 is a cross-section view diagram illustrating the door closer of the present invention.

With reference to FIGS. 1, 2 and 6, a door closer 100 of the present invention is pivoted on a door (not shown) and includes a case 110, a piston 140 and a driving module 170. The piston 140, which connects to the driving module 170, includes a main body 141 and an oil sealing ring 142, wherein the oil sealing ring 142 is coupled to and moved together with the main body 141. Preferably, the oil sealing ring 142 is a back-up ring. In this embodiment, the case 110 includes a driving module accommodating chamber 111, a piston accommodating chamber 112 and a spacer accommodating chamber 113. However, the case 110 in other embodiment only has the driving module accommodating chamber 111 and the piston accommodating chamber 112.

Figure 7:
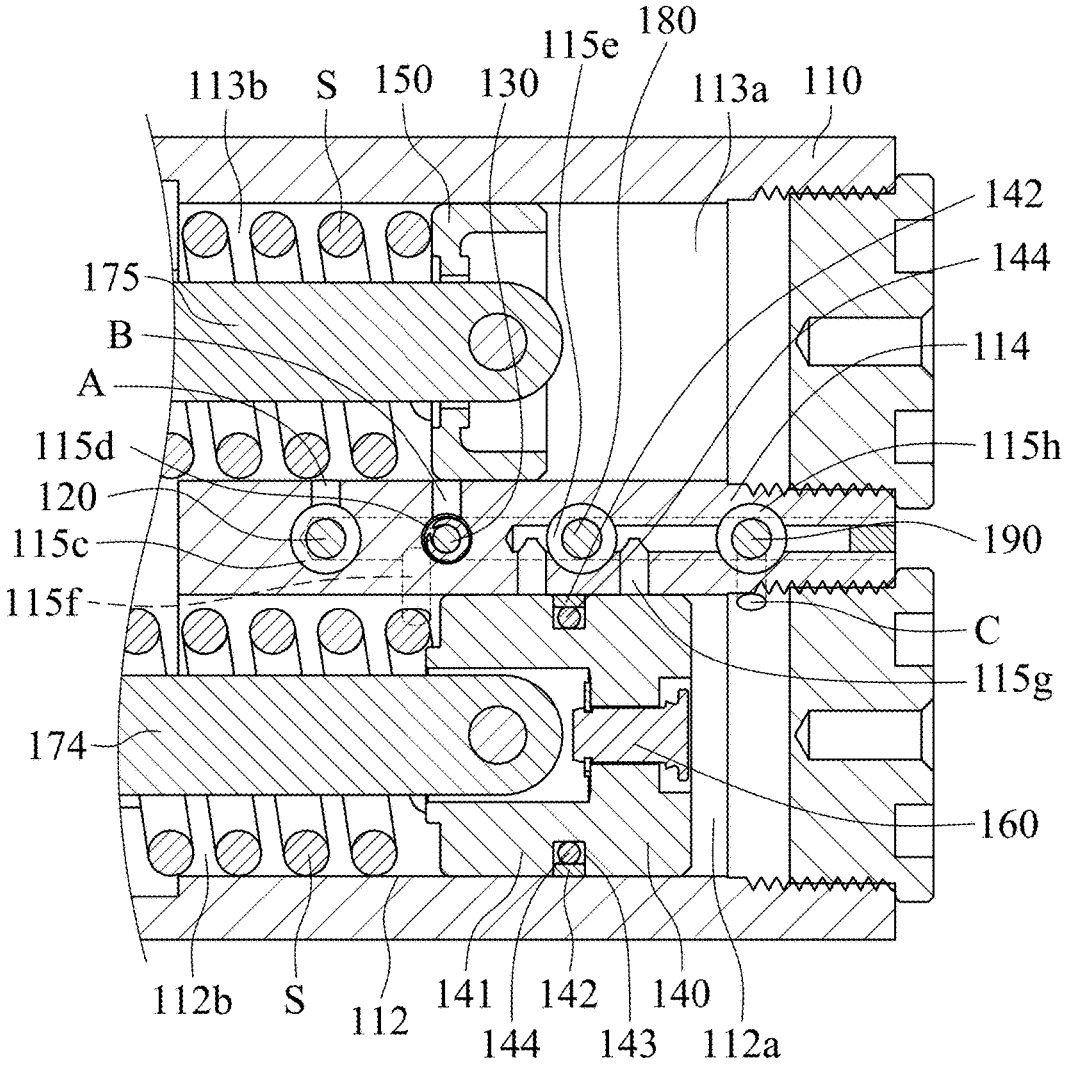
FIG. 7 is a partial magnified view diagram of FIG. 6.

With reference to FIGS. 2 to 5, the piston accommodating chamber 112 and the spacer accommodating chamber 113 communicate with the driving module accommodating chamber 111 respectively. With reference to FIGS. 6 and 7, the driving module 170 is installed in the driving module accommodating chamber 111, and the piston 140 is installed in the piston accommodating chamber 112 and divides the piston accommodating chamber 112 into a first oil storage space 112*a* and a first opening space 112*b*, wherein the piston accommodating chamber 112 communicates with the driving module accommodating chamber 111 by the first opening space 112*b*. When the door is opening or closing, the driving module 170 drives the piston 140 to move in the piston accommodating chamber 112.

Figure 5:
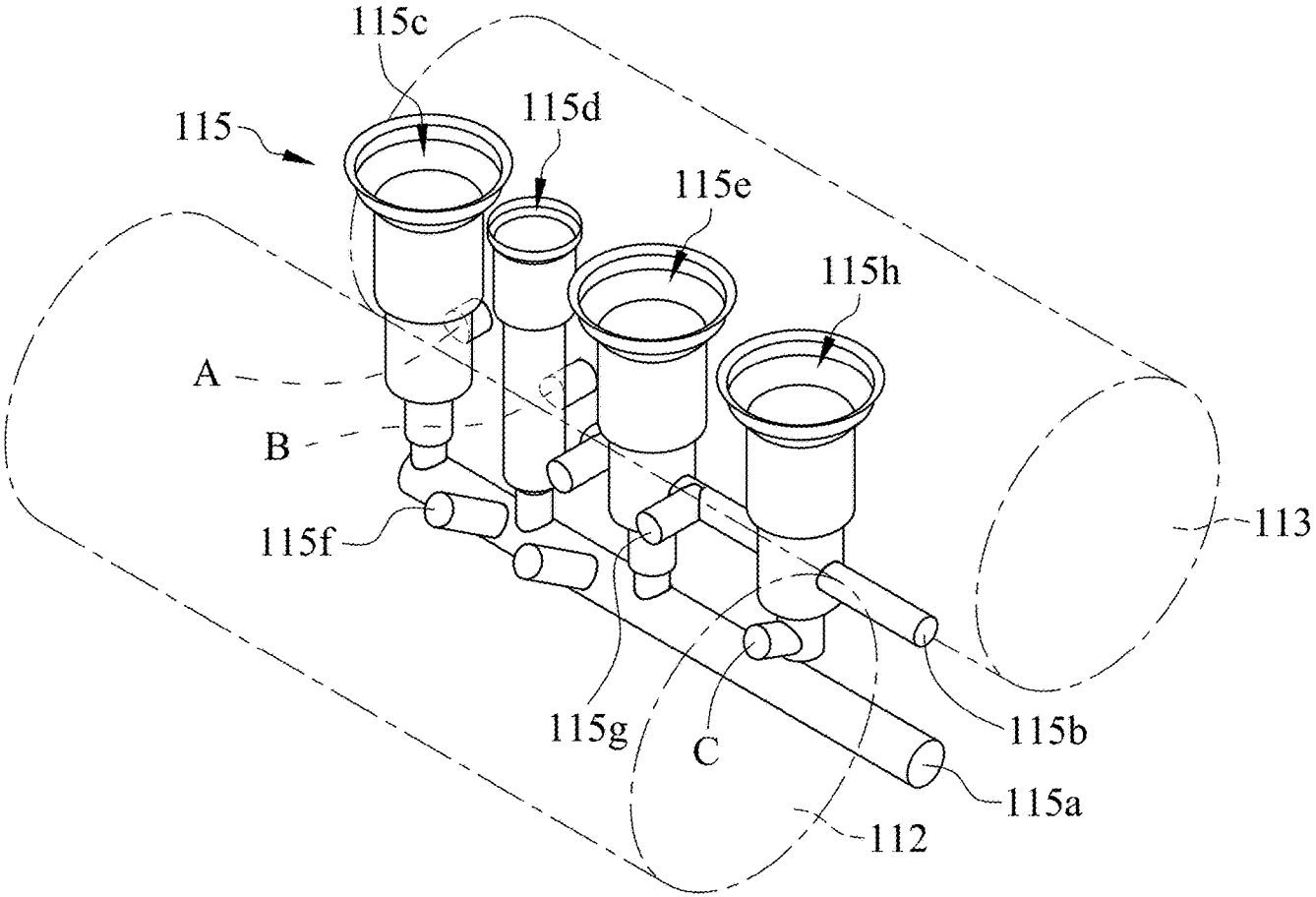
FIG. 5 is a perspective diagram illustrating a channel connecting module of the door closer of the present invention.

With reference to FIGS. 2 to 5, the case 110 includes a channel connecting module 115, wherein the channel connecting module 115 communicates with the first oil storage space 112*a* and the first opening space 112*b*, and includes a first communicating hole 115*f* and a second communicating hole 115*g*. With reference to FIGS. 5 and 6, the channel connecting module 115 communicates with the first opening space 112*b* via the first communicating hole 115*f*, and communicates with the first oil storage space 112*a* via the second communicating hole 115*g*.

With reference to FIGS. 2 to 5, the case 110 includes a partition wall 114 located between the piston accommodating chamber 112 and the spacer accommodating chamber 113 in this embodiment, wherein the piston accommodating chamber 112 and the spacer accommodating chamber 113 are separated by the partition wall 114, and the channel connecting module 115 is installed in the partition wall 114. The channel connecting module 115 includes a first primary channel 115*a* and a second primary channel 115*b* which are individual channels. The first communicating hole 115*f* communicates with the first primary channel 115*a* and the first opening space 112*b*, and the second communicating hole 115*g* communicates with the second primary channel 115*b* and the first oil storage space 112*a*.

With reference to FIGS. 2 to 5, the channel connecting module 115 further includes a first tributary channel 115*c*, a second tributary channel 115*d* and a third tributary channel 115*e*. The first tributary channel 115*c* communicates with the first primary channel 115*a* and the spacer accommodating chamber 113, wherein the first communicating hole 115*f* is located between the first tributary channel 115*c* and the second tributary channel 115*d*, and the first tributary channel 115*c* is located between the driving module accommodating chamber 111 and the second tributary channel 11*d*. In this embodiment, the first tributary channel 115*c* has a first hole A which communicates with the spacer accommodating chamber 113. The second tributary channel 115*d* communicates with the first primary channel 115*a* and the spacer accommodating chamber 113, and is located between the first tributary channel 115*c* and the third tributary channel 115*e*. In this embodiment, the second tributary channel 115*d* has a second hole B which communicates with the spacer accommodating chamber 113. The third tributary channel 115*e*, which is located between the second tributary channel 115*d* and the second communicating hole 115*g*, communicates with the first primary channel 115*a* and the second primary channel 115*b*.

With reference to FIGS. 2 to 5, the channel connecting module 115 further includes a fourth tributary channel 115*h* in this embodiment, wherein the second communicating hole 115*g* is located between the third tributary channel 115*e* and the fourth tributary channel 115*h*. The fourth tributary channel 115*h* communicates with the second primary channel 115*b*, and has a third hole C which communicates with the piston accommodating chamber 112.

Figure 9:
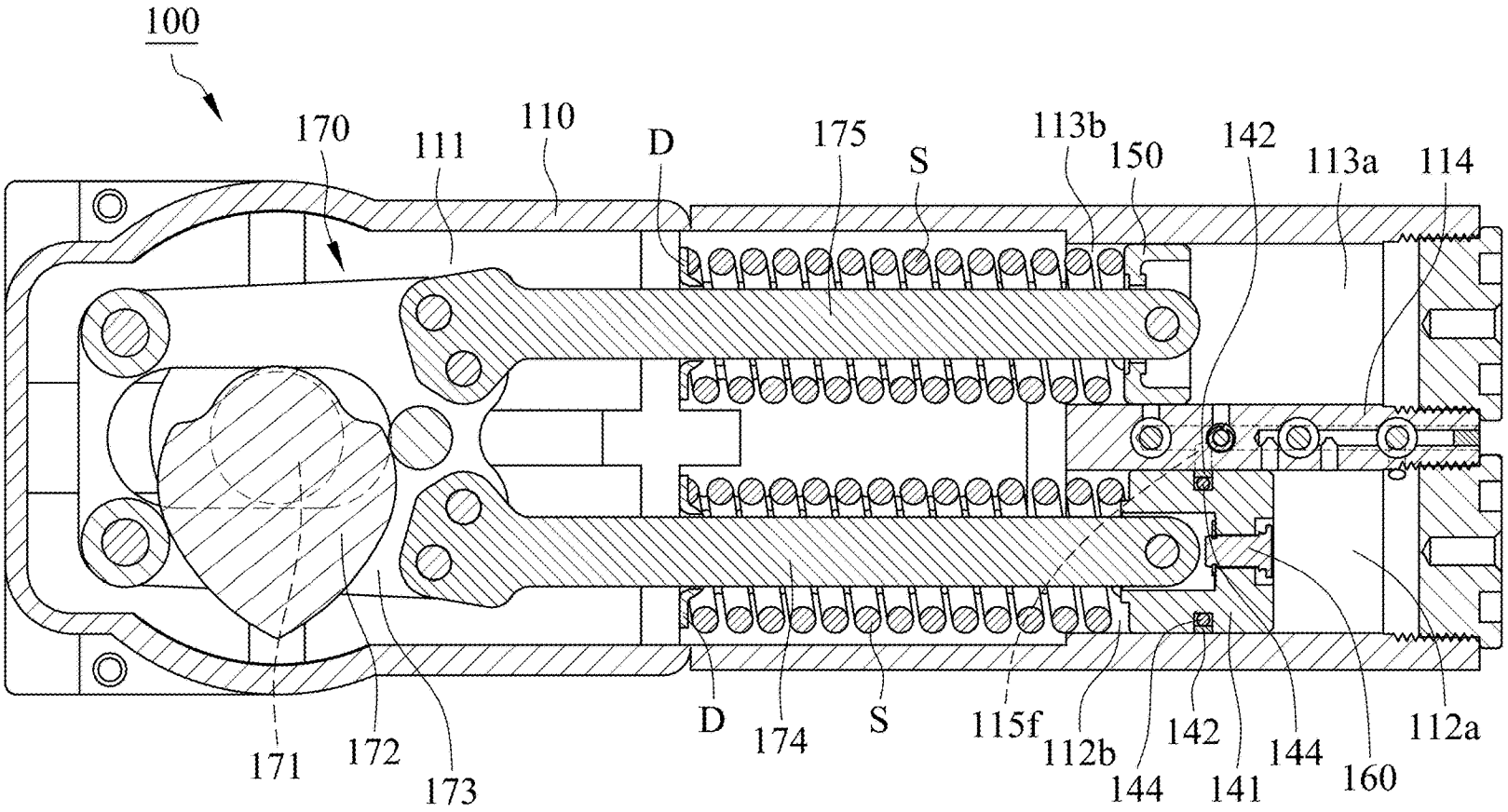
FIG. 9 is a cross-section view diagram illustrating the door closer of the present invention.
Figure 10:
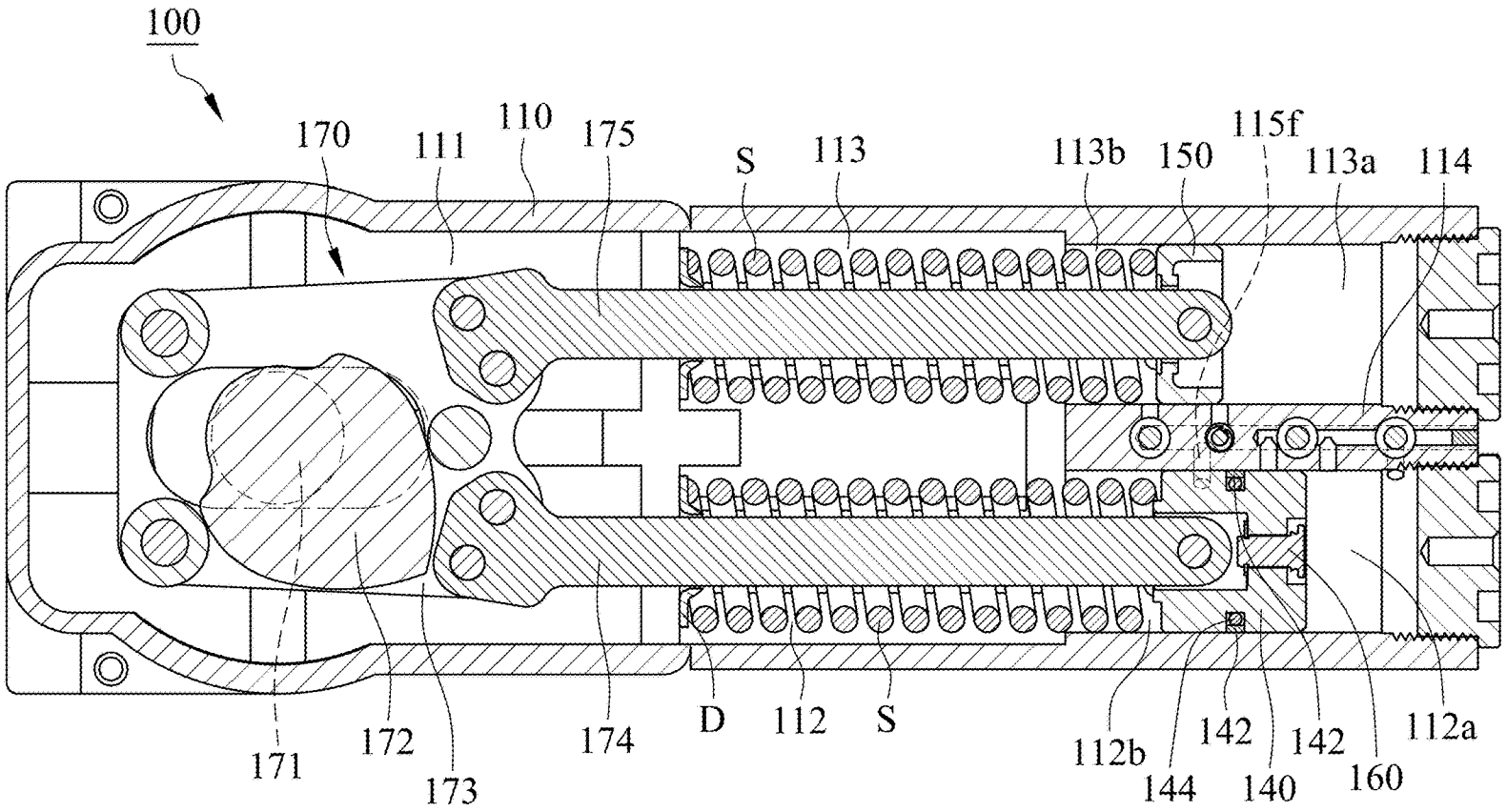
FIG. 10 is a cross-section view diagram illustrating the door closer of the present invention.

With reference to FIGS. 2 to 6, an oil (not shown) is filled in the driving module accommodating chamber 111, the piston accommodating chamber 112, the spacer accommodating chamber 113 and the channel connecting module 115. With reference to FIGS. 6 and 9, the driving module 170 can drive the piston 140 to allow the main body 141 and the oil sealing ring 142 to move in the piston accommodating chamber 112 when the door is opening or closing. With reference to FIG. 9, when the door is open to a predetermined position, the piston 140 can block the first communicating hole 115*f* by the oil sealing ring 142 to cause the oil filled in the first oil storage space 112*a* cannot flow to the first opening space 112*b* through the first communicating hole 115*f*. As such, the open door can be held in the predetermined position.

With reference to FIGS. 2, 6 and 7, the main body 141 includes a groove 143 in this embodiment. The oil sealing ring 142 is placed in the groove 143 and protrudes from the main body 141. Preferably, the piston 140 further includes an O-ring 144 which is placed in the groove 143, and the O-ring 144 is located between the main body 141 and the oil sealing ring 142 to support the oil sealing ring 142.

With reference to FIGS. 2, 3, 5, 6 and 8, the door closer 100 further includes a first flow regulating valve 120, a pressure valve 130, a spacer 150 and a backflow valve 160, wherein the driving module 170 connects with the spacer 150. The first flow regulating valve 120 is installed in the first tributary channel 115*c* to selectively block the first tributary channel 115*c*. The pressure valve 130 is installed in the second tributary channel 115*d* to allow the oil to only flow in one direction from the second tributary channel 115*d* to the spacer accommodating chamber 113.

With reference to FIGS. 2, 6 and 9, the spacer 150 is installed in the spacer accommodating chamber 113, and the driving module 170 can drive the spacer 150 to move in the spacer accommodating chamber 113 while the door is opening or closing. The spacer accommodating chamber 113 is divided into a second oil storage space 113*a* and a second opening space 113*b* by the spacer 115, and the second opening space 113*b* communicates with the driving module accommodating chamber 111. In this embodiment, the first tributary channel 115*c* communicates with the driving module accommodating chamber 111 through the first hole A and the second opening space 113*b*. The backflow valve 160 is installed in the piston 140 to allow the oil in the piston accommodating chamber 112 to flow in one direction.

With reference to FIGS. 2 to 8, the door closer 100 further includes a second flow regulating valve 180 and a third flow regulating valve 190 in this embodiment. The second flow regulating valve 180 is installed in the third tributary channel 115*e* to selectively block the third tributary channel 115*e*. In normal use, the second flow regulating valve 180 does not block the third tributary channel 115*e*, so the second primary channel 115*b* can communicate with the first primary channel 115*a*. The third flow regulating valve 190 is installed in the fourth tributary channel 115*h* to selectively block the fourth tributary channel 115*h*, and in normal use, the third flow regulating valve 190 blocks the fourth tributary channel 115*h*. Furthermore, the second primary channel 115*b* cannot communicate with the first primary channel 115*a* when the second flow regulating valve 180 blocks the third tributary channel 115*e*. For this reason, the oil cannot flow between the first primary channel 115*a* and the second primary channel 115*b*.

With reference to FIGS. 2, 6, 7 and 8, the driving module 170 includes a shaft 171, a cam 172, a driven member 173 and a first connecting rod 174, wherein the cam 172 is installed on the shaft 171 and rotates together with the shaft 172. A top portion 171*a* of the shaft 171 protrudes from the case 110 to couple with the door. Preferably, the door closer 100 further includes at least one elastic member S which is a compression spring placed on the first connecting rod 174. Both ends of the first connecting rod 174 connect to the driven member 173 and the piston 140 respectively. In this embodiment, there is a baffle board D arranged in the case 110, and both ends of the elastic member S contact with the baffle board D and the piston 140 respectively.

With reference to FIGS. 2, 6, 7 and 8, in this embodiment, the driving module 170 further includes a second connecting rod 175 and another elastic member S placed on the second connecting rod 175. Both ends of the second connecting rod 175 connect to the driven member 173 and the spacer 150 respectively, and both ends of the elastic member S contact with the baffle board D and the spacer 150 respectively. The shaft 171 can rotate the cam 172 to drive the driven member 173, the first connecting rod 174 and the second connecting rod 175. When opening or closing the door, the driving module 170 can drive the piston 140 and the spacer 150 move in the piston accommodating chamber 112 and the spacer accommodating chamber 113 respectively.

The operation of the door closer 100 for closing the open door or holding the open door in the predetermined position is illustrated below.

With reference to FIGS. 5 to 9, while the first flow regulating valve 120 does not block the first tributary channel 115*c* and the pressure valve 130 blocks the second tributary channel 115*d*, the first opening space 112*b* and the first oil storage space 112*a* communicate with each other through the first communicating hole 115*f*, the first primary channel 115*a*, the third tributary channel 115*e*, the second primary channel 115*b* and the second communicating hole 115*g*. With reference to FIGS. 6 and 9, the door can rotate the shaft 171 when it is pulled or pushed open, and the rotated shaft 171 can rotate the cam 172 to drive the driven member 173. Then the driven member 173 can pull the first connecting rod 174 and the piston 140 toward the shaft 171 to allow the piston 140 to compress the elastic member S. As a result, the oil filled in the first opening space 112*b* can flow to the first oil storage space 112*a* via the backflow valve 160 in the piston 140, wherein the backflow valve 160 can prevent the oil in the first oil storage space 112*a* from flowing back to the first opening space 112*b*.

With reference to FIGS. 5, 8, 9 and 10, owing to the pressure valve 130 blocks the second tributary channel 115*d* and the first flow regulating valve 120 does not block the first tributary channel 115*c* in normal use, the elastic member S can push the piston 140 to compress the oil in the first oil storage space 112*a* to flow to the second opening space 113*b* of the spacer accommodating chamber 113 through the second communicating hole 115*g*, the second primary channel 115*b*, the third tributary channel 115*e*, the first primary channel 115*a* and the first hole A of the first tributary channel 115*c* in sequence to close the door.

With reference to FIGS. 5 to 9, blocking the first tributary channel 115*c* and the second tributary channel 115*d*, respectively, by the first flow regulating valve 120 and the pressure valve 130 can allow the open door to be normally open. When the door is open, the oil can flow to the first oil storage space 112*a* via the backflow valve 160, but the oil cannot flow to the spacer accommodating chamber 113 through the second communicating hole 115*g*, the second primary channel 115*b*, the third tributary channel 115*e*, the first primary channel 115*a* and the first tributary channel 115*c* because the first flow regulating valve 120 blocks the first tributary channel 115*c*. With reference to FIG. 9, owing to the oil sealing ring 142 of the piston 140 blocks the first communicating hole 115*f* while the door is open to the predetermined position, the oil cannot flow to the first opening space 112*b* of the piston accommodating chamber 112 via the first communicating hole 115*f*, so the open door can be held in the predetermined position.

With reference to FIGS. 5 to 10, the pressure valve 130 in the second tributary channel 115*d* is adapted to protect the door closer 100 from damage caused by forcing the door. And when intending to close the open door held in the predetermined position, an external force has to be applied to the door to allow the oil filled in the first oil storage space 112*a*, the second communicating hole 115*g*, the second primary channel 115*b*, the third tributary channel 115*e* and the first primary channel 115*a* to push the pressure valve 130 to unblock the second tributary channel 115*d*. As such, the oil can flow to the spacer accommodating chamber 113 through the second hole B of the second tributary channel 115*d*, and the piston 140 can be pushed by the elastic member S to compress the oil in the first oil storage space 112*a*. Finally, the oil can flow to the second opening space 113*b* through the second communicating hole 115*g*, the second primary channel 115*b*, the third tributary channel 115*e*, the first primary channel 115*a* and the second tributary channel 115*d* for closing the door.

Figure 8:
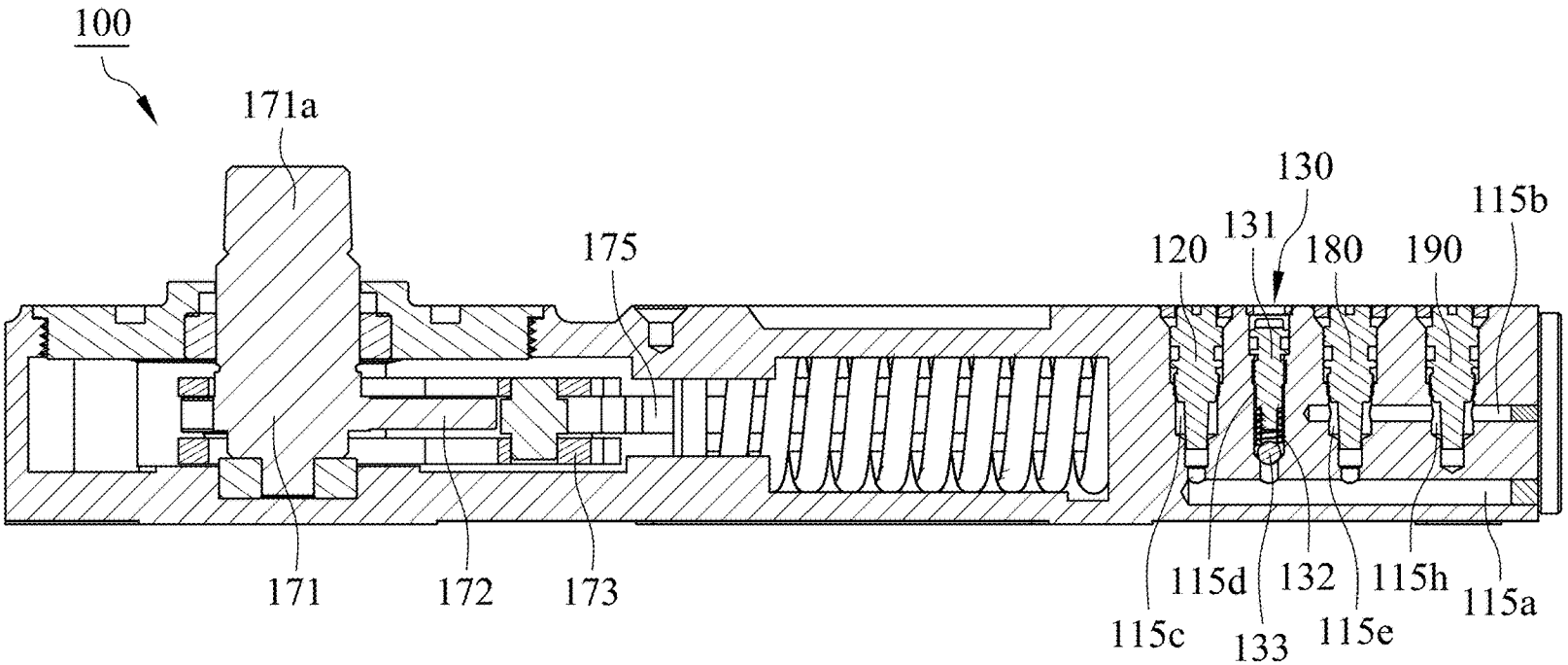
FIG. 8 is a cross-section view diagram illustrating the door closer of the present invention.

With reference to FIGS. 2 and 8, the pressure valve 130 includes a bolt portion 131, an elastic member 132 and a stop portion 133 in this embodiment. The bolt portion 131 is screwed into the second tributary channel 115*d*, and the elastic member 132 is placed between the bolt portion 131 and the stop portion 133, wherein the elastic member 132 is adapted to push the stop portion 133 to block the second tributary channel 115*d*. When pushing the door closed, the oil in the first oil storage space 112*a*, the second communicating hole 115*g*, the second primary channel 115*b*, the third tributary channel 115*e* and the first primary channel 115*a* can push the stop portion 133 to unblock the second tributary channel 115*d*, so the oil can pass through the second tributary channel 115*d* and flow to the spacer accommodating chamber 113.

With reference to FIGS. 5 to 8, the oil in the first oil storage space 112*a* cannot flow to the first primary channel 115*a* via the fourth tributary channel 115*h* because the third flow regulating valve 190 blocks the fourth tributary channel 115*h*. If the door cannot close accurately and there is a gap between the closed door and a door frame (not shown), the third flow regulating valve 190 can be adjusted to unblock the fourth tributary channel 115*h*. And the oil in the first oil storage space 112*a* can flow through the fourth tributary channel 115*h*, the second primary channel 115*b*, the third tributary channel 115*e*, the first primary channel 115*a* and the first tributary channel 115*c* in sequence into the second opening space 113*b* to allow the door to be closed accurately.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A door closer pivoted on a door, comprising:

a case including a piston accommodating chamber and a channel connecting module, wherein the channel connecting module includes a first communicating hole and a second communicating hole, wherein the case further includes a driving module accommodating chamber, a spacer accommodating chamber configured to accommodate a spacer and a partition wall, the partition wall is located between the piston accommodating chamber and the spacer accommodating chamber for separating the piston accommodating chamber and the spacer accommodating chamber, the piston accommodating chamber and the spacer accommodating chamber communicate with the driving module accommodating chamber respectively, and the piston accommodating space communicates with the driving module accommodating chamber by the first opening space, wherein the channel connecting module is installed in the partition wall and includes a first primary channel, a second primary channel, a first tributary channel, a second tributary channel and a third tributary channel, the first tributary channel communicates with the first primary channel and the spacer accommodating chamber, the second tributary channel communicates with the first primary channel and the spacer accommodating chamber, the third tributary channel communicates with the first and second primary channels;

a piston installed in the piston accommodating chamber and dividing the piston accommodating chamber into a first oil storage space and a first opening space, wherein the channel connecting module communicates with the first opening space by the first communicating hole and communicates with the first oil storage space by the second communicating hole, and wherein the piston includes a main body and an oil sealing ring which is coupled to and moved together with the main body in the piston accommodating chamber, and the oil sealing ring is adapted to block the first communicating hole for holding the door in a predetermined position when the door is open;

a first flow regulating valve installed in the first tributary channel and adapted to selectively block the first tributary channel;

a driving module installed in the driving module accommodating chamber and adapted to drive the piston; and a pressure valve installed in the second tributary channel and adapted to allow an oil to flow in one direction from the second tributary channel to the spacer accommodating chamber.

2. The door closer in accordance with claim 1, wherein the main body includes a groove, and the oil sealing ring is placed in the groove and protrudes from the main body.

3. The door closer in accordance with claim 2, wherein the piston further includes an O-ring which is placed in the groove, and the O-ring is located between the main body and the oil sealing ring for supporting the oil sealing ring.

4. The door closer in accordance with claim 1, wherein the first tributary channel is located between the driving module accommodating chamber and the second tributary channel, the first communicating hole is located between the first and second tributary channels, the second tributary channel is located between the first and third tributary channels, and the third tributary channel is located between the second tributary channel and the second communicating hole.

5. The door closer in accordance with claim 1 further comprises a second flow regulating valve, wherein the second flow regulating valve is installed in the third tributary channel to selectively block the third tributary channel.

6. The door closer in accordance with claim 1 further comprises a third flow regulating valve, and the channel connecting module further includes a fourth tributary channel, wherein the second communicating hole is located between the third and fourth tributary channels, the fourth tributary channel communicates with the second primary channel and the first oil storage space, and the third flow regulating valve is installed in the fourth tributary channel to selectively block the fourth tributary channel.

7. The door closer in accordance with claim 1 further comprises a spacer installed in the spacer accommodating chamber, configured to accommodate said spacer, wherein the spacer is adapted to divide the spacer accommodating chamber into a second oil storage space and a second opening space, and the second opening space communicates with the driving module accommodating chamber.

8. The door closer in accordance with claim 1, wherein the driving module includes a shaft, a cam, at least one driven member, a first connecting rod and a second connecting rod, the shaft is adapted to drive the driven member by the cam, both ends of the first connecting rod connect to the driven member and the piston respectively, and both ends of the second connecting rod connect to the driven member and the spacer respectively.

9. A door closer pivoted on a door, comprising:

a case including a piston accommodating chamber and a channel connecting module, wherein the channel connecting module includes a first communicating hole and a second communicating hole, wherein the case further includes a driving module accommodating chamber, a spacer accommodating chamber configured to accommodate a spacer and a partition wall, the partition wall is located between the piston accommodating chamber and the spacer accommodating chamber for separating the piston accommodating chamber and the spacer accommodating chamber, the piston accommodating chamber and the spacer accommodating chamber communicate with the driving module accommodating chamber respectively, and the piston accommodating space communicates with the driving module accommodating chamber by the first opening space, wherein the channel connecting module is installed in the partition wall and includes a first primary channel, a second primary channel, a first tributary channel and a third tributary channel, the first tributary channel communicates with the first primary channel and the spacer accommodating chamber, the third tributary channel communicates with the first and second primary channels;

a piston installed in the piston accommodating chamber and dividing the piston accommodating chamber into a first oil storage space and a first opening space, wherein the channel connecting module communicates with the first opening space by the first communicating hole and communicates with the first oil storage space by the second communicating hole, and wherein the piston includes a main body and an oil sealing ring which is coupled to and moved together with the main body in the piston accommodating chamber, and the oil sealing ring is adapted to block the first communicating hole for holding the door in a predetermined position when the door is open;

a first flow regulating valve installed in the first tributary channel and adapted to selectively block the first tributary channel;

a second flow regulating valve installed in the third tributary channel and adapted to selectively block the third tributary channel; and a driving module installed in the driving module accommodating chamber and adapted to drive the piston.

10. A door closer pivoted on a door, comprising:

a case including a piston accommodating chamber and a channel connecting module, wherein the channel connecting module includes a first communicating hole and a second communicating hole, wherein the case further includes a driving module accommodating chamber, a spacer accommodating chamber configured to accommodate a spacer and a partition wall, the partition wall is located between the piston accommodating chamber and the spacer accommodating chamber for separating the piston accommodating chamber and the spacer accommodating chamber, the piston accommodating chamber and the spacer accommodating chamber communicate with the driving module accommodating chamber respectively, and the piston accommodating space communicates with the driving module accommodating chamber by the first opening space, wherein the channel connecting module is installed in the partition wall and includes a first primary channel, a second primary channel, a first tributary channel, a third tributary channel and a fourth tributary channel, the second communicating hole is located between the third and fourth tributary channels, the first tributary channel communicates with the first primary channel and the spacer accommodating chamber, the third tributary channel communicates with the first and second primary channels, the fourth tributary channel communicates with the second primary channel and the first oil storage space;

a piston installed in the piston accommodating chamber and dividing the piston accommodating chamber into a first oil storage space and a first opening space, wherein the channel connecting module communicates with the first opening space by the first communicating hole and communicates with the first oil storage space by the second communicating hole, and wherein the piston includes a main body and an oil sealing ring which is coupled to and moved together with the main body in the piston accommodating chamber, and the oil sealing ring is adapted to block the first communicating hole for holding the door in a predetermined position when the door is open;

a first flow regulating valve installed in the first tributary channel and adapted to selectively block the first tributary channel;

a third flow regulating valve installed in the fourth tributary channel and adapted to selectively block the fourth tributary channel; and a driving module installed in the driving module accommodating chamber and adapted to drive the piston.

* * * * *